US005443363A

United States Patent [19]

Cho

[11] Patent Number: 5,443,363

[45] Date of Patent: Aug. 22, 1995

[54] ASSEMBLY OF FAN AND SHROUD

[75] Inventor: Kyung-seok Cho, Seoul, Rep. of Korea

[73] Assignee: Halla Climate Control Corporation, Kyungki-do, Rep. of Korea

[21] Appl. No.: 222,237

[22] Filed: Apr. 4, 1994

Related U.S. Application Data

[63] Continuation-in-part of Ser. No. 95,920, Jul. 23, 1993, abandoned.

[30] Foreign Application Priority Data

Jul. 24, 1992 [KR] Rep. of Korea ..... 92-13710

[51] Int. Cl.[6] ..... F04D 29/54

[52] U.S. Cl. ..... 415/211.1; 415/208.2; 415/211.2; 415/223

[58] Field of Search ..... 415/173.1, 173.5, 173.6, 415/173.7, 172.1, 186, 208.1, 208.2, 208.3, 208.5, 211.1, 211.2, 119, 48.1, 220, 223; 416/189 R, 192 R, 195, 169 A; 123/41.49

[56] References Cited

U.S. PATENT DOCUMENTS 3,903,960 9/1975 Beck et al. ..... 415/211.1
4,514,140 4/1985 Knopf ..... 415/119
5,066,194 11/1991 Amr et al. ..... 415/223
5,215,437 6/1993 TeVelde et al. ..... 415/223

FOREIGN PATENT DOCUMENTS 0650308 6/1992 Australia ..... 415/223

*Primary Examiner*—Edward K. Look
*Assistant Examiner*—Christopher Verdier
*Attorney, Agent, or Firm*—Leydig, Voit & Mayer

[57] ABSTRACT

An assembly of a fan and shroud is provided in which a shroud has an inner ring which is substantially cylindrical to guide airflow by surrounding blades, an outer ring which has a diameter greater than that of the inner ring and surrounds both the blades and inner ring, and a bell-mouthed airflow guide portion which structurally connects the inner ring and outer ring on the air exhaust side and has a diameter which is gradually enlarged in an air exhaust direction, a section of the airflow guide portion having the shape of part of a circle or ellipse, which starts from a point on an air-exhaust-side extension line of the inner ring and is connected to the outer ring, with the center and the point of tangency thereof both lying along an extension line of the outer ring.

2 Claims, 5 Drawing Sheets

ASSEMBLY OF FAN AND SHROUD

This application is a continuation-in-part application of U.S. patent application Ser. No. 08/095,920 filed Jul. 23, 1993 but now abandoned.

BACKGROUND OF THE INVENTION

The present invention relates to an assembly of a fan and a shroud, and more particularly, to an assembly of a fan and a shroud which is easy to manufacture and has improved structural strength and high efficiency.

In general, according to the principle of fluid dynamics, an assembly of a fan and a shroud used in a vehicle is provided with a bell-mouthed airflow guide portion on all air inflow or outflow side, so as to increase airflow volume. Such a structure is disclosed in U.S. Pat. Nos. 4,514,140 to Knopf, 4,566,852 to Hauser, 5,066,194 to Amr et al., 2,030,993 to Langenkamp et al., 3,515,498 to Tomita, 3,842,902 to Poslusny, and 5,244,347 to Gallivan et al.

The above known air guiding structures have a bell-mouthed airflow guide portion on the air inflow/outflow side so as to smoothly induce or discharge incoming or outgoing air as much as possible and accordingly to increase airflow volume.

However, since general shrouds including those of the above inventions are made of metal consisting of plural individual elements, they are difficult to assemble. Further, difficulty in adjusting assembly tolerance prevents the gap between the fan blade and shroud from being adequately maintained and therefore air leakage created via the gap between the fan and shroud cannot be positively suppressed. Meanwhile, FIG. 1 illustrates the assembly of fan 1 and shroud 2 made of synthetic resin by injection molding. Referring to FIG. 1, in order to form a bell-mouthed airflow guide portion 3, the mold assembly requires more than three sets of molding segments. Further, since the bell-mouthed airflow guide portion 3 is formed with a simple plate-shaped member without reinforcement, the airflow guide portion is subject to damage due to the low mechanical strength and to distortion due to impacts and warping.

SUMMARY OF THE INVENTION

Therefore, to solve the above defects, it is an object of the present invention to provide an assembly of a fan and a shroud which is easy to manufacture and has improved mechanical strength.

It is another object of the present invention to provide an assembly of a fan and a shroud which is improved in efficiency so as to increase its airflow volume.

To accomplish the above object of the present invention, there is provided an assembly of fan and shroud which includes a motor, a fan rotated by the motor and having a plurality of blades, and a shroud which surrounds the fan, wherein the shroud comprises an inner ring which is substantially cylindrical to guide airflow by surrounding the blades; an outer ring which has a diameter greater than that of the inner ring and surrounds both the blades and inner ring; and a bell-mouthed airflow guide portion which structurally connects the inner ring and outer ring on the air exhaust side and is gradually enlarged in an air exhaust direction, a section of the airflow guide portion having the shape of part of a circle or ellipse, which starts from a point on an air-exhaust-side extension line of the inner ring and is connected to the outer ring, with the center and the point of tangency thereof both lying along an extension line of the outer ring.

BRIEF DESCRIPTION OF THE DRAWINGS

The above objects and advantages of the present invention will become more apparent by describing in detail a preferred embodiment of the present invention with reference to the attached drawings in which.

DESCRIPTION OF THE PREFERRED EMBODIMENT

Hereinbelow, one embodiment of the present invention will be described in more detail with reference to the attached drawings.

Figure 1:
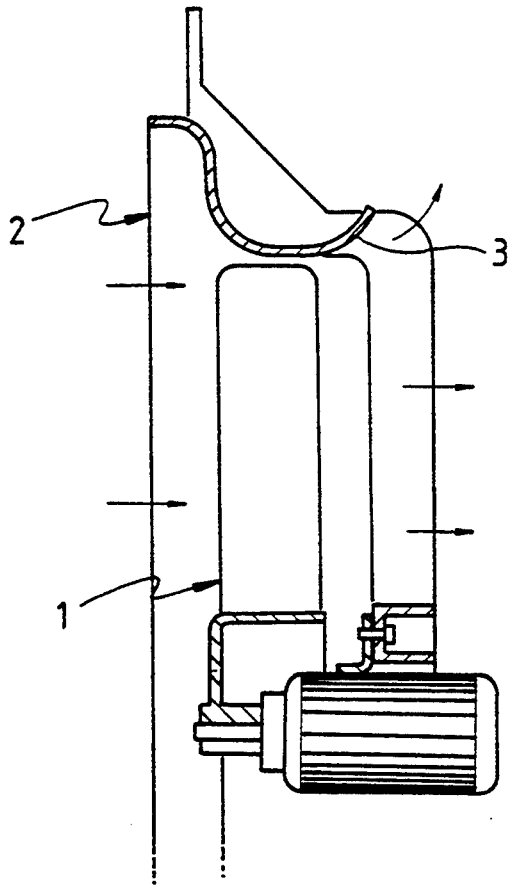
FIG. 1 (PRIOR ART)
FIG. 1 is a schematic cross-sectional view of a conventional assembly of fan and shroud.
Figure 2:
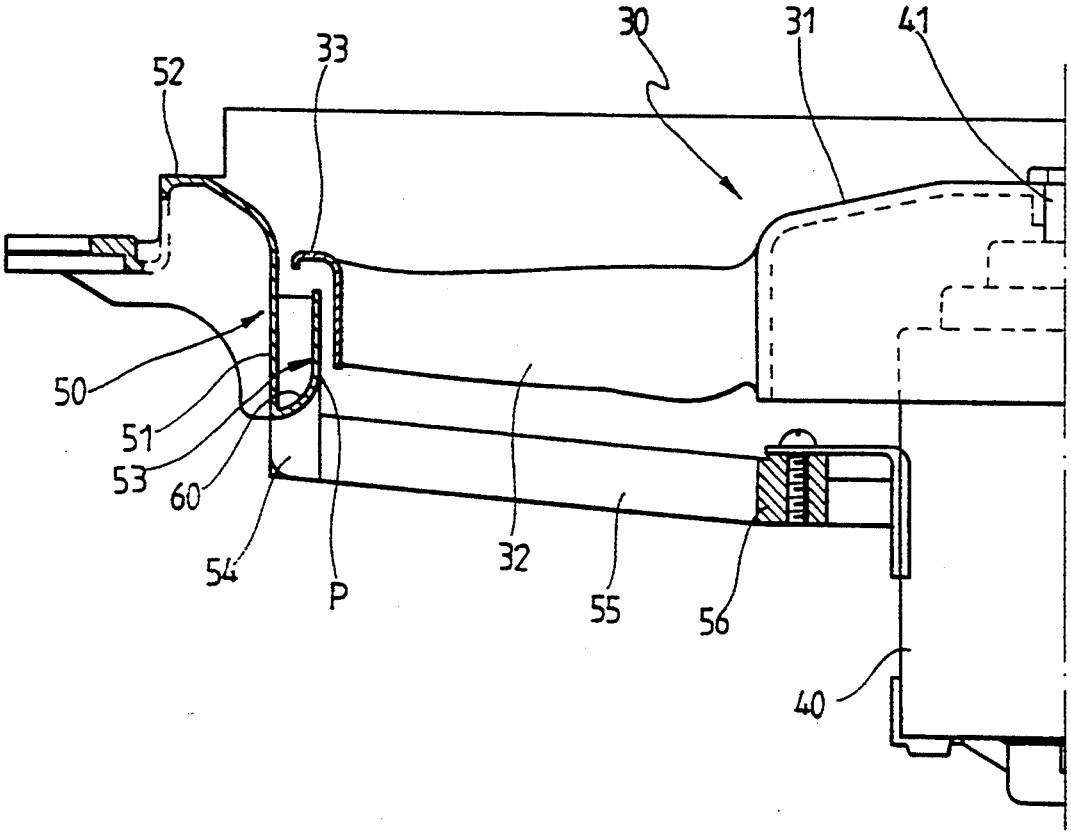
FIG. 2 is a cross-sectional view of the first embodiment of the fan-and-shroud assembly of the present invention.

In FIG. 2 showing one embodiment of an assembly of a fan and a shroud according to the present invention, the fan-and-shroud assembly comprises a fan 30 for generating airflow, a motor 40 for rotating fan 30, and a shroud 50 for guiding air moved by fan 30 and suppressing the recirculation of air.

Fan 30 has a hub 31 connected with a rotation axis 41 of motor 40. A plurality of blades 32 are formed along a circumferential surface of hub 31, at a predetermined spacing. A ring band 33 is formed on one end of each blade 32, to connect the blade ends with each other. As reinforcement, the ring band is made with a plate-shaped member so as to stabilize the air flow by connecting blades 32 and suppresses mechanical vibration and deformation of blades 32.

Figure 3:
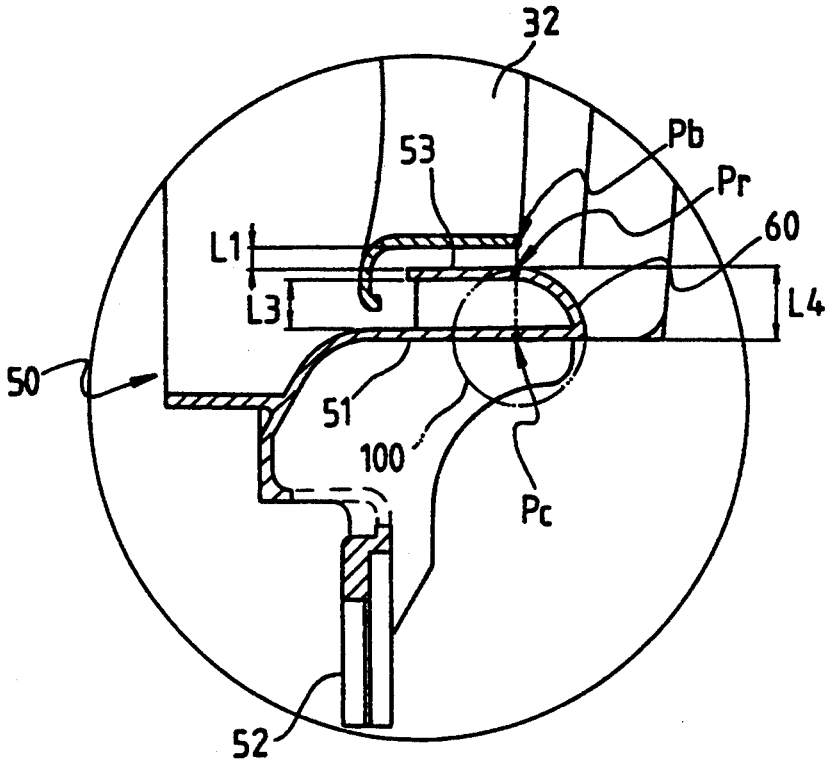
FIG. 3 is an extracted cross-sectional view of the airflow guide portion shown in FIG. 1 according to the present invention.

The shroud 50, as shown in FIG. 3, comprises an inner ring 53 which surrounds the rotation locus of the outmost air-exhaust end of blade 32 while being spaced apart by a predetermined vertical distance L1, an outer ring 51 which surrounds both inner ring 53 and the rotation locus of blade 32 while being spaced apart by a predetermined distance L3, a bell-mouthed airflow guide portion 60 for structurally connecting inner 53 and outer ring 51 on the air exhaust side, and a fixing portion 52 placed outside of the outer ring. It is favorable to the suppression of air leakage and counterflow that distance L1, that is, the distance between inner ring 53 and the outermost end of blade 32 is as short as possible. The minimization of the distance L1 can be attained according to the characteristic configuration of the present invention which will be explained hereinbelow.

The cross sections of inner ring 53 and outer ring 51 of shroud 50 both are parallel with respect to the rotation axis of fan 30. Outer ring 51 is formed with a plate-shaped member which is broader than inner ring 53.

The airflow guide portion 60 is also made with a plate-shaped member which functions to connect inner ring 53 and outer ring 51, and simultaneously, to guide exhaust air as having a shape gradually enlarged in the air exhaust direction. By connecting inner ring 53 and outer ring 51, airflow guide portion 60 enhances the mechanical strength of inner ring 53 and outer ring 51 and accordingly suppresses the distortion or deformation of inner ring 53 and outer ring 51 caused due to external impacts or warping of physical properties. According to such a structure in which the deformation is suppressed, the distance L1 between inner ring 53 and edge point Pb of blade 32 can be minimized and held to within a range in which the interference between the fan blade and inner ring are suppressed. The smaller the value L1 becomes, the more the air leakage and counterflow are minimized, so that airflow efficiency is improved.

Between inner ring 53 and outer ring 51 is provided a doughnut-shaped cavity which is opened toward the air inflow side. The width of the cavity is uniform throughout its length because the inner ring and outer ring are formed parallel with each other as described above, so that the insertion and extraction of the molding segments are enabled during injection molding. Therefore, the shroud 50 of the present invention requires only one set of molding segments, that is, upper and lower molding segments, which are coupled at the same direction as rotation axis 41 of motor 40. This is because the shroud has a structure in which the number of molding segments required for injection molding is minimized, in other words, because the inner ring, outer ring and airflow guide portion are formed to structurally reduce the number of molding segments.

A plurality of protecting ribs 55, one of which is illustrated in FIG. 2, are provided in the opening portion of the exhaust side of the shroud 50 for protecting the plurality of blades 32. The plurality of protecting ribs 55 are supported by a plurality of outer supporters 54 and a ring-type inner supporter 56. The plurality of outer supporters 56 are provided in the bell mouth type air flow guide portion 60. The ring-type inner supporter 56 also functions to support the motor.

Figure 4:
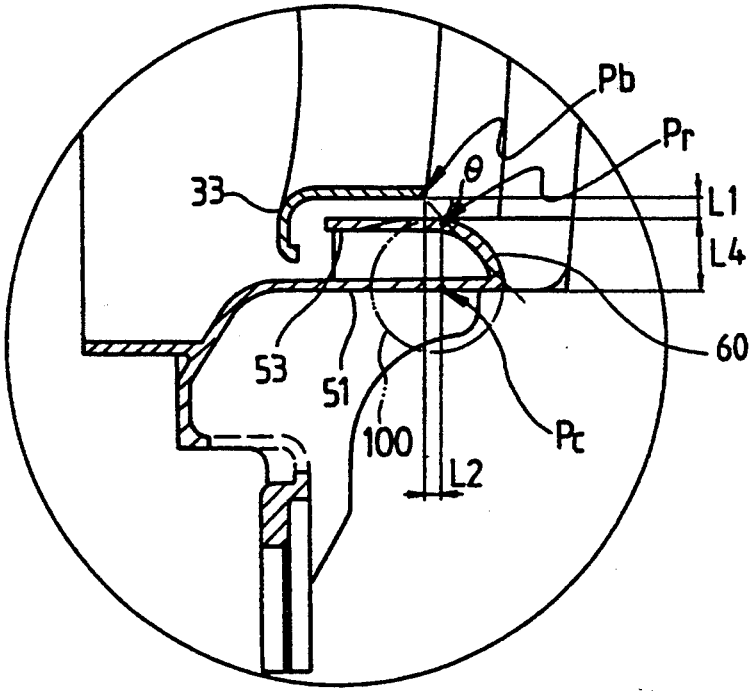
FIG. 4 is a partially extracted cross-sectional view of the airflow guide portion according to another embodiment of the present invention.
Figure 3A:
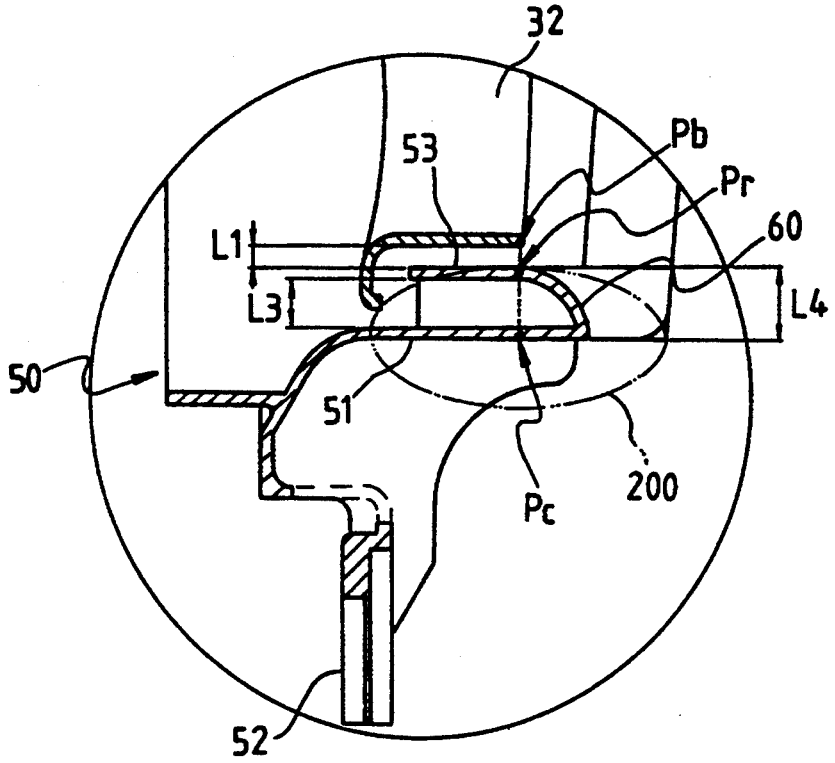
FIG. 3*a* is an extracted cross-sectional view of an alternate airflow guide portion of FIG. 3.
Figure 4A:
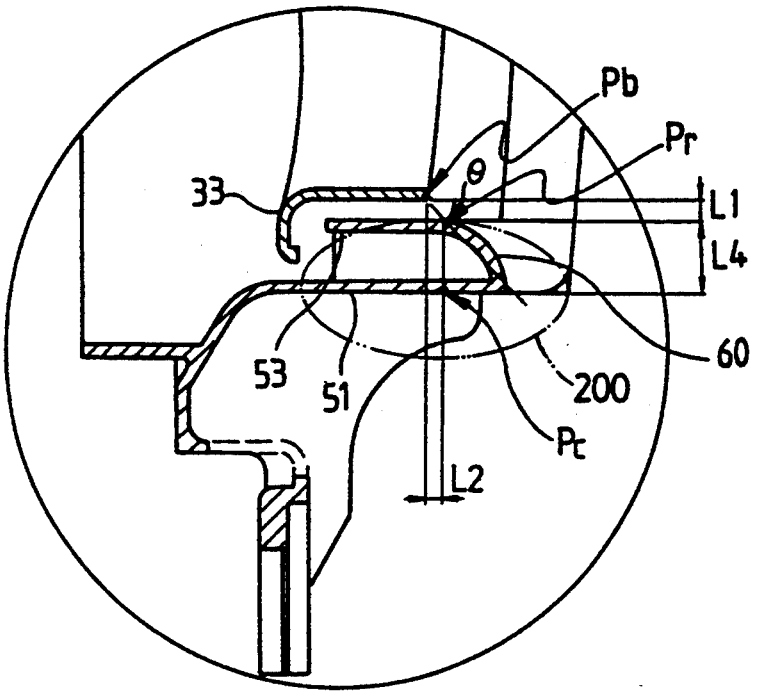
FIG. 4*a* is a partially extracted cross-sectional view of an alternate airflow portion of FIG. 4.

As shown in FIG. 3, the airflow guide portion 60 corresponds to part, say, one fourth, of circle 100 as shown in FIG. 3*a*, ellipse 200. The central point Pc of the airflow guide portion coincides with a vertical line passing through edge point Pb of blade 32 on the air exhaust side. The contact point Pr of inner ring 53 and airflow guide portion 60, that is, the point of tangency of the circle or ellipse coincides with a line connecting the central point Pc and edge point Pb. The distance L4 between contact point Pr and central point Pc is the radius of circle 100 or the shorter radius of the ellipse 200. In terms of the enhancement of airflow efficiency, it is most preferable that edge point Pb, contact point Pr and central point Pc are located on a line perpendicular to the rotation axis of the motor, as shown in FIG. 3. In FIG. 4, edge point Pb, contact point Pr and central point Pc are not located on the line perpendicular to the rotation axis, and contact point Pr and central point Pc deviate from edge point Pb toward the air exhaust side by distance L2. As in FIGS. 3 and 3*a*, FIG. 4 illustrates the airflow guide potion corresponds to a portion of a circle, and in FIG. 4*a* a portion of an ellipse.

The deviation distance L2 of central point Pc is set to be less than or equal to a value in which the distance L1 between the blade and inner ring 53 is divided by tan 10°. In other words, the deviation distance L2 can be expressed as equation $L2 \leqq L1/\tan 10°$.

As motor 40 rotates fan 30, the fan-and-shroud assembly generates airflow in a direction oblique to rotation axis 41, that is, in an angle formed by rotation axis 41 of fan 30 and the radius direction of fan 30. Thus, the airflow exhaust by blade 32 of fan 30 has an axial component and a radial component.

Figure 5:
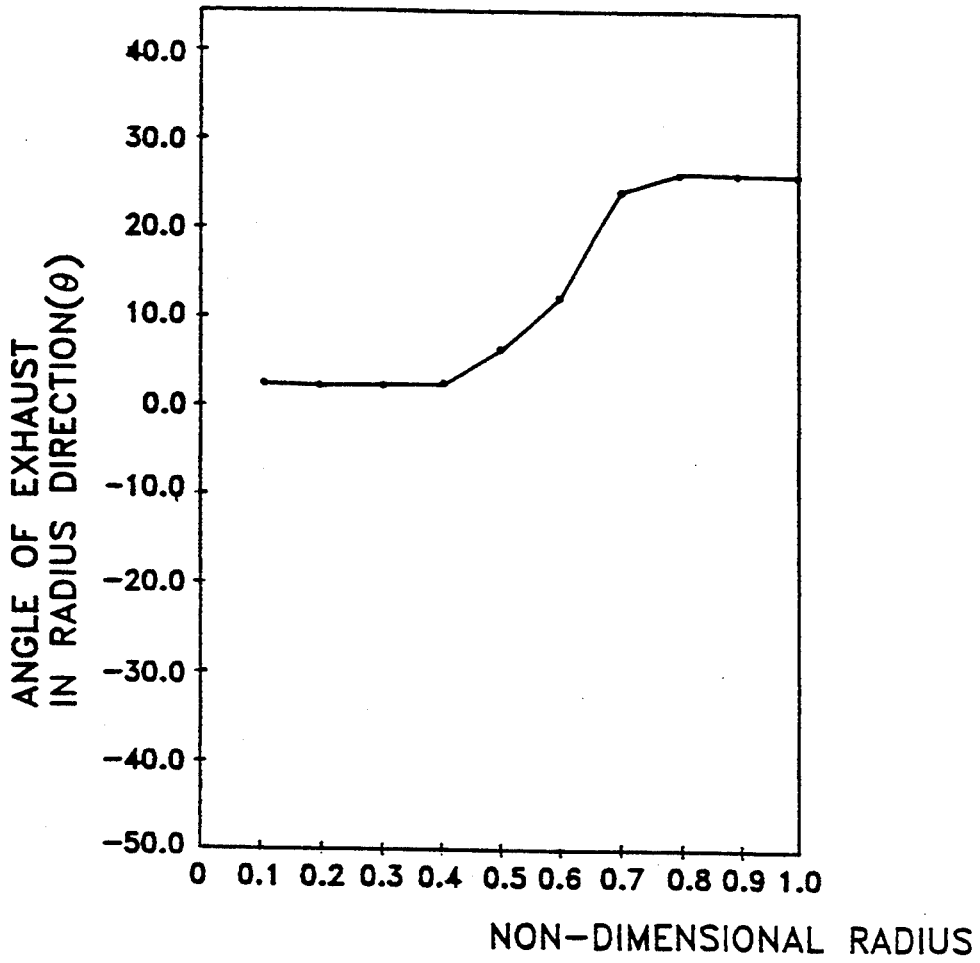
FIG. 5 is a graph showing a relationship between a non-dimensional radius of the fan and a radius-direction exhaust angle of the airflow.

The inventor plotted the graph of FIG. 5 showing a relationship between a radial exhaust angle with respect to a rotation axis 41 of the discharged airflow having the axial component and the radial component, and the non-dimensional radius. Here, the non-dimensional radius is obtained by dividing a value obtained by subtracting the hub radius from the distance between the center of the hub and any point on the blade, by a value obtained by subtracting the hub radius from the fan radius.

Figure 6:
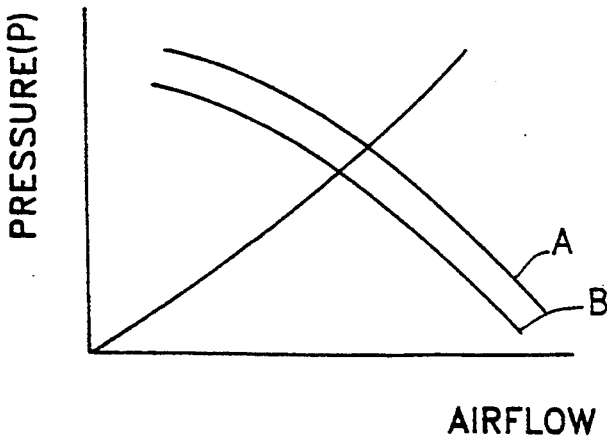
FIG. 6 is a graph showing a relationship between an airflow rate and a pressure of the fan-and-shroud assembly according to the present invention, and a relationship between an airflow rate and a pressure of the conventional fan-and-shroud assembly.

Thus, since airflow guide portion 60 is formed between inner ring 53 and outer ring 51 of shroud according to the present invention, the discharged airflow exhaust between non-dimensional radius 0.7 to 1.0 of blade 32 in the radius direction is guided by the airflow guide portion, to prevent the air discharged from the edge of the blade from colliding with the inner wall of the shroud. Thus, inner ring 53 and airflow guide portion 60 smoothly guide the airflow, so as to fundamentally remove the static pressure which increases at the exhaust side, and to reduce the generation of noise due to the airflow's sudden change of direction. Particularly, since the static pressure can be reduced at the exhaust side of fan 30, the fan's efficiency can be improved. Referring to the graph of FIG. 6, it can be seen that when shroud 50 according to the present invention is used (represented as line "A"), the exhaust pressure and the airflow rate are increased by about 15%, in comparison with that when the conventional fan-and-shroud assembly is used (represented as line "B").

As described above, the fan-and-shroud assembly according to the present invention can minimize the airflow discharged from the fan's perimeter from colliding with the inner wall of the shroud, to maximize the fan's efficiency, and can definitely prevent the airflow generated from the blade ends from being recirculated.

In conclusion, since the fan-and-shroud assembly of the present invention is improved in mechanical strength according to the coupling structure of the inner and outer rings and the airflow guide portion which connects them, the present invention enhances the assembly's resistance against impacts and vibration. In addition, the assembly of the present invention can be manufactured with structurally fewest number of molding segments, and its production cost is lowered. Furthermore, thanks to the efficient, smooth air-guiding structure, the present invention absolutely prevents air leakage and counterflow so that, eventually, airflow rate is increased and energy consumption is reduced.

What is claimed is:

1. A fan and shroud assembly which includes a motor, said fan rotated by said motor and having a plurality of blades, and said shroud surrounds said fan, wherein said shroud comprises:

an inner ring which is substantially cylindrical to guide airflow by surrounding said blades;

an outer ring which has a diameter greater than that of said inner ring and surrounds both said blades and inner ring; and a bell-mouthed airflow guide portion which structurally connects said inner ring and outer ring and has a diameter which is gradually enlarged in an air exhaust direction, and a section of said airflow guide portion having the shape of part of a circle or ellipse, which starts from a point on an air-exhaust-side extension line of said inner ring and is connected to said outer ring, with a center and a point of tangency of said circle or ellipse both lying along an extension line of said outer ring, wherein a contact point of said inner ring and said airflow guide portion and a line perpendicular to the rotation axis of said fan and passing the center of the circle or ellipse deviates from a line perpendicular to the rotation axis of said fan and passes the edge point of said blade on the air exhaust side by a distance being less than or equal to a value in which the vertical distance between said edge point of said blade and said contact point is divided by tan 10°.

2. The fan and shroud assembly according to claim 1, wherein the section of said airflow guide portion substantially corresponds to one fourth a circle or ellipse.

* * * * *